US006800834B2

(12) United States Patent
Kawai

(10) Patent No.: US 6,800,834 B2
(45) Date of Patent: Oct. 5, 2004

(54) ARRANGEMENT OF A HIGH-VOLTAGE CONDENSER IN A HIGH-FREQUENCY APPARATUS

(75) Inventor: Kazuhiro Kawai, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/354,699

(22) Filed: Jan. 30, 2003

(65) Prior Publication Data

US 2003/0155352 A1 Aug. 21, 2003

(30) Foreign Application Priority Data

Jan. 31, 2002 (JP) ..... P.2002-023035

(51) Int. Cl.[7] ..... H05B 6/66
(52) U.S. Cl. ..... 219/702; 219/715; 219/756
(58) Field of Search ..... 219/702, 715, 219/756, 757

(56) References Cited

U.S. PATENT DOCUMENTS 4,549,054 A * 10/1985 Aoyama ..... 219/685
6,414,287 B2 * 7/2002 Han et al. ..... 219/715

* cited by examiner

*Primary Examiner*—Philip H. Leung
(74) *Attorney, Agent, or Firm*—Pearne & Gordon LLP

(57) ABSTRACT

A part of a body of a high-voltage condenser (28) is arranged between a lower plate (23) constituting a heating chamber (21), and a bottom plate (27) thereby to reduce attachment dimension of the high-voltage condenser (28), whereby size-reduction and space-reduction of the high-frequency heating apparatus becomes possible, and an insulation distance between the high-voltage condenser (28) and metal-made parts constituting the high-frequency heating apparatus can be secured easily, so that the number of the parts can be reduced. Therefore, it is possible to provide the high-frequency heating apparatus which is advantageous also in resources-reduction, assembly efficiency, and price.

3 Claims, 13 Drawing Sheets

PRIOR ART

PRIOR ART

PRIOR ART

PRIOR ART

ARRANGEMENT OF A HIGH-VOLTAGE CONDENSER IN A HIGH-FREQUENCY APPARATUS

BACKGROUND OF THE INVENTION

1. Field of the Invention

The present invention relates to an attachment method of a high-voltage condenser used in a high-voltage circuit of a high-frequency heating apparatus and attachment fittings for the high-voltage condenser.

2. Description of the Related Art

In a high-voltage circuit of a high-frequency heating apparatus, a high-voltage condenser has been used till now in order to obtain half-wave voltage double commutation. As its attachment method, there are methods shown in FIGS. 10, 11 and 12, 13.

In an example shown in FIGS. 10 and 11, below a resin-made orifice 1, a high-voltage condenser 3 is held between the orifice and a half-oval attachment fittings 2, and the attachment fittings 2 is fixed with a screw from a side of a back plate 4.

In an example shown in FIGS. 12 and 13, a high-voltage condenser 6 is held by an attachment fittings 7, and the attachment fittings 7 is fixed to a flat portion 8A of a bottom plate 8 with a screw 9 from the inside.

However, in the example shown in FIGS. 10 and 11, since the high-voltage condenser 3 is attached below the orifice 1, the size of the orifice 1 becomes large, so that there is a problem in resources-reduction. Further, since the width of the orifice 1 must be made larger than the length (L1) of the high-voltage condenser 3, there are problems in size-reduction and space-reduction of the high-frequency heating apparatus. Further, since a terminal portion 3A of the high-voltage condenser 3 is close to the metal-made back plate 4, an outer frame 10 and a bottom plate 11, sufficient insulation distance cannot be secured. Therefore, it is necessary to stick an insulating sheet 12 on the inside of the outer frame 10 or coat a lead wire 13 connecting to the terminal portion 3A of the high-voltage condenser 3 with an insulating tube 14, so that there are also problems in resources-reduction, assembly efficiency, and price. Further, since the high-voltage condenser 3 is placed below the orifice 1, it does not receive wind from a cooling fan 15 at all but is cooled naturally, so that there is a problem in level-up of output.

Further, in the example shown in FIGS. 12 and 13, the high-voltage condenser 6 is held by the oval attachment fittings 7, and the attachment fittings 7 is fixed onto the flat portion 8A of the bottom plate 8 with the screw 9 from the inside. However, similarly to in the example shown in FIG. 10, attachment dimension of the length (L2) of the high-voltage condenser 6 is required, so that there are problems in size-reduction and space-reduction of the high-frequency heating apparatus. Further, since a insulation distance between the high-voltage condenser 6 and a metal-made back plate 16 or an outer frame 17 cannot be sufficiently secured. Therefore, it is necessary to stick an insulating sheet 18 on the inside of the outer frame 17 or coat a lead wire 19 connecting to the high-voltage condenser 6 with an insulating tube 20, so that there are also problems in resources-reduction, assembly efficiency, and price. Further, since the attachment fittings 7 holding the high-voltage condenser 6 is fixed to the flat portion 8A of the bottom plate 8 with the screw 9, the screw 9 protrudes downward from the bottom plate 8. Therefore, when a user handles the high-frequency heating apparatus, the screw 9 touches his hand, so that an unpleasant feeling or a sense of incompatibility in appearance is given to him.

SUMMARY OF THE INVENTION

In order to solve the problems in size-reduction, space-reduction, resources-reduction, assembly efficiency, and price, in the first aspect of the invention, a part of a body of a high-voltage condenser is arranged between a heating chamber bottom wall and a bottom plate.

A heating chamber of a high-frequency heating apparatus includes side plates, a lower plate, an upper plate, a front plate and a back plate. Flange portions are formed respectively at the lower portions of the front plate and the back plate, and a bottom plate is fixed to the flange portions of the front plate and the back plate. Apart of the body of the high-voltage condenser is arranged between the lower plate constituting the heating chamber and the bottom plate, the high-voltage condenser is held by an attachment fittings, and the attachment fittings is fixed onto the bottom plate.

According to the first aspect, since a part of the body of the high-voltage condenser is thus arranged between the heating chamber lower plate and the bottom plate, the dimension regulated by the length of the high-voltage condenser can be reduced, so that size-reduction and space-reduction of the high-frequency heating apparatus are possible.

Further, an outer frame is attached so as to cover the front plate and the back plate that are attached to the front and the back of the heating chamber. Since by arranging a part of the body of the high-voltage condenser between the heating chamber lower plate and the bottom plate, the insulation distance between a terminal portion of the high-voltage condenser and the outer frame can be sufficiently secured, it is not necessary to-stick an insulating sheet on the outer frame, so that the problems in resources-reduction, assembly efficiency, and price can be also solved.

In order to solve the problems in resources-reduction, assembly efficiency, and price, in the second aspect of the invention, flange portions are formed respectively at the lower ends of a front plate and a back plate that form a heating chamber, a bottom plate is fixed to the flange portions of the front plate and the back plate, and valley portions drawn downward in order to attach leg rubbers are formed in a bottom plate. A terminal portion of a high-voltage condenser is arranged on the valley portion, and the high-voltage condenser is held through an attachment fittings at a mountainous portion formed at the bottom plate.

According to the second aspect, the leg rubbers for supporting the high-frequency heating apparatus are attached apart from the back plate and the outer frame so as not to overturn in view of the weight balance of the high-frequency heating apparatus, and the terminal portion of the high-voltage condenser is arranged on the valley portion of the bottom plate formed in order to attach the leg rubber. Hereby, the insulation distance between the terminal portion of the high-voltage condenser and the metal-made back plate or outer frame can be secured sufficiently. Further, since the terminal portion of the high-voltage condenser is arranged on the leg rubber attachment portion formed by drawing the bottom plate downward, the insulation distance between the bottom plate and the terminal portion of the high-voltage condenser can be also sufficiently secured. Therefore, it is not necessary to stick an insulating sheet on the inside of an outer frame or to cover a lead wire with an insulating tube because of shortage of the insulation distance produced in the conventional examples, so that the problems in resources-reduction, assembly efficiency, and price can be solved.

In order to remove the unpleasant feeling at the handling time or a sense of incompatibility in appearance in the examples, in the third aspect of the invention, flange portions are formed respectively at the lower ends of a front plate and a back plate that form a heating chamber, the front and the back of a bottom plate is fixed to the flange portions of the front plate and the back plate, a high-voltage condenser is held by an attachment fittings, the attachment fittings is fixed to a mountainous portion formed at the bottom plate with a screw from the inside of the bottom portion, and the screw is surrounded by valley portions formed in the bottom plate more deeply than the length of the screw.

According to the third aspect, though the screw for holding the high-voltage condenser is tightened from the inside of the bottom plate and protrudes downward from the bottom plate, since it is surrounded by the valley portions drawn downward more deeply than the length of the screw, it is possible to solve such the problems that the unpleasant feeling is given by touch of the screw on user's hand at the carrying time of a high-frequency heating apparatus or a sense of incompatibility in appearance is given because the screw can be seen from the downside of the valley portion of the bottom plate.

In order to solve the problems in resources-reduction, assembly efficiency, price, and cooling efficiency of high-voltage condenser, in the fourth aspect of the invention, a magnetron is fixed to a magnetron attaching plate fixed to a heating chamber sidewall, a bottom plate is attached to lower ends of a front plate and a back plate that form a heating chamber, a high-voltage transformer is attached on the bottom plate, a cooling motor having a cooling fan is attached to the back plate, a high-voltage condenser is arranged at a position nearer to the windward of the cooling fan than the magnetron and the high-voltage transformer, and the high-voltage condenser is held through an attachment fittings on the magnetron attaching plate.

According to the fourth aspect, since the high-voltage condenser is thus held through the attachment fittings on the magnetron attaching plate, it can be held at a position sufficiently distant from the metal-made back plate and bottom plate. Therefore, it is possible to solve the problem in resources-reduction, assembly efficiency, and price that a lead wire is covered with an insulating tube. Further, since the high-voltage condenser is arranged at the position nearer to cooling fan than the high-voltage transformer and the magnetron hereby to forcedly receive wind from the cooling fan, cooling performance of the high-voltage condenser improves, so that the problem in level-up of output can be solved.

In order to solve the problems in size-reduction, space-reduction, resources-reduction, assembly efficiency, and price, according to the fifth aspect of the invention, a drawn portion protruding backward is formed at a back plate constituting a heating chamber, a back portion of a high-voltage condenser is inserted into this drawn portion, a terminal portion side of the high-voltage condenser is held by an attachment fittings, the attachment fittings is fixed to a bottom plate, and the high-voltage condenser is arranged in the depth direction of the high-frequency heating apparatus.

According to the fifth aspect, since high-voltage condenser is thus held in the depth direction of the high-frequency heating apparatus, it is possible to solve the problem that the size-reduction and space-reduction of the high-frequency heating apparatus are impossible due to the length of the high-voltage condenser. Further, it is easy to secure the insulation distance between the high-voltage condenser and the metal-made back plate, the bottom plate or an outer frame, and it is possible to solve such the problem in resources-reduction, assembly efficiency, and price that an insulating sheet or an insulating tube is used because of shortage of the insulation distance.

DETAILED DESCRIPTION OF THE PREFERRED EMBODIMENTS

Embodiments of the invention will be described below with reference to drawings.

Embodiment 1

Figure 1:
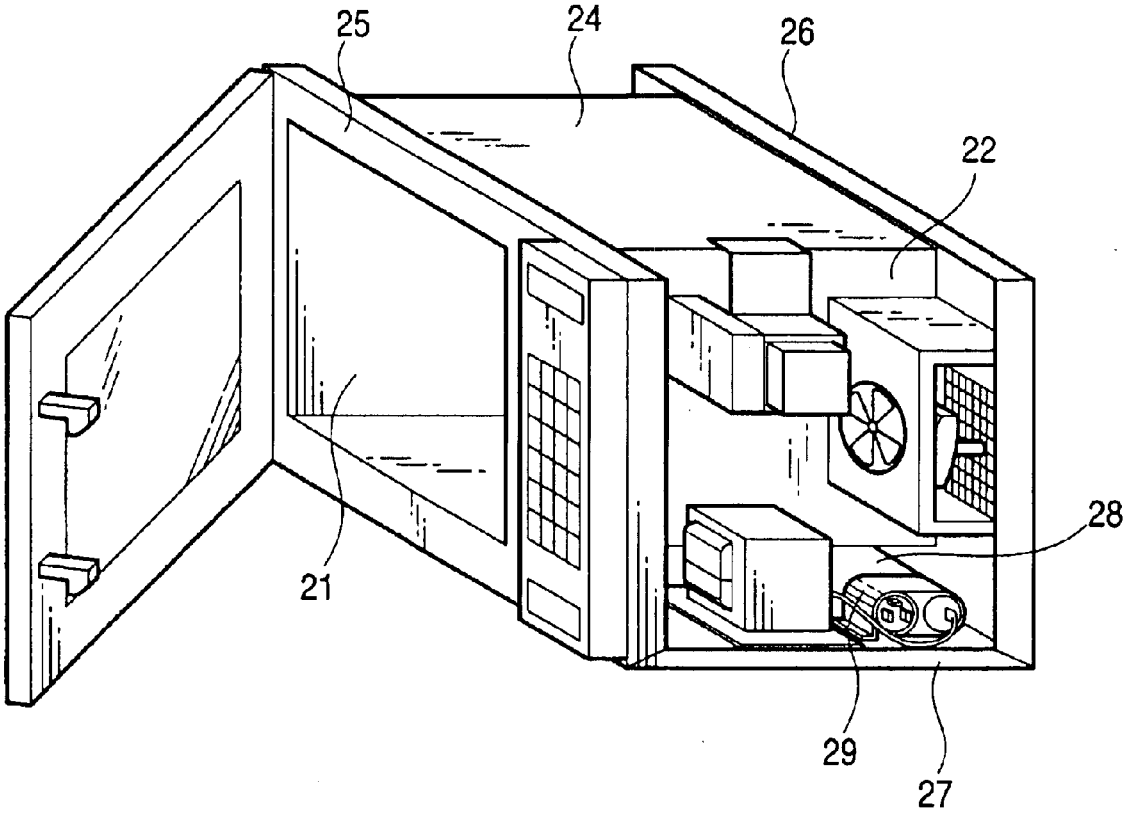
FIG. 1 is a perspective view showing an attachment method of a high-voltage condenser in a first embodiment of the invention.
Figure 2:
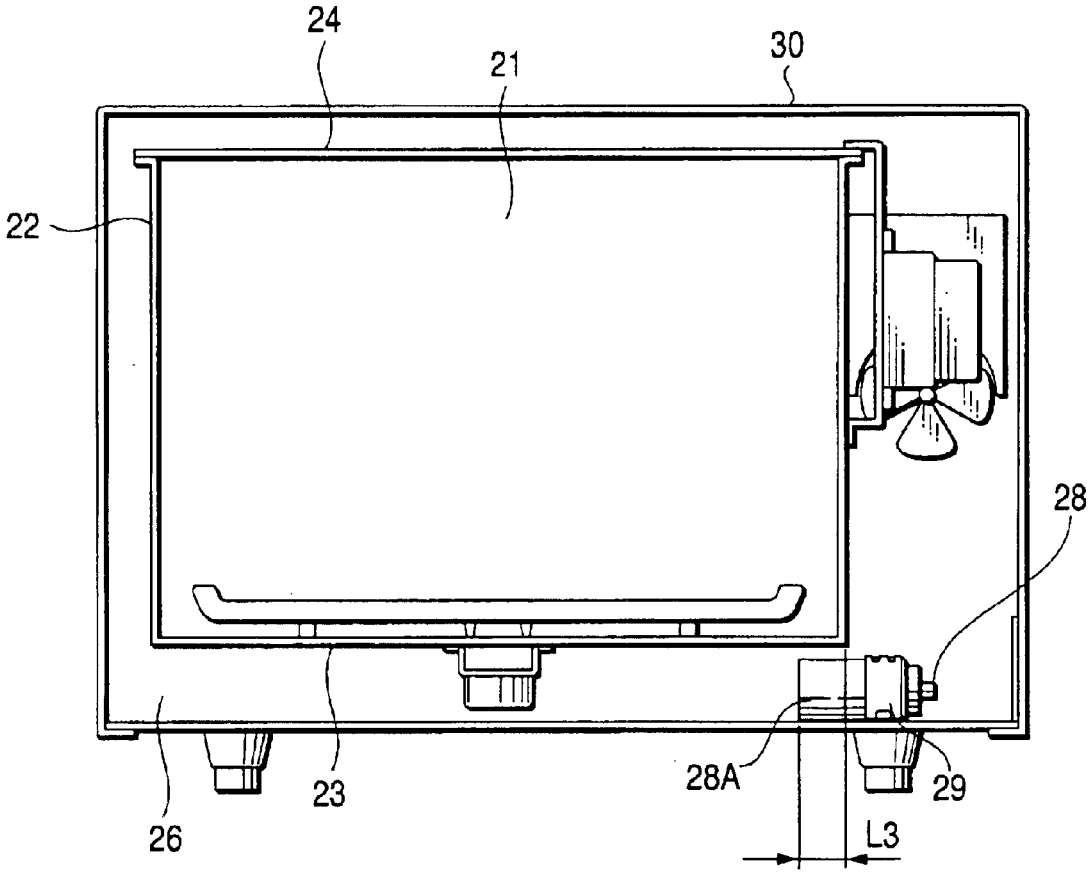
FIG. 2 is a sectional view showing an arranging state of the high-voltage condenser in the first embodiment of the invention.
Figure 3:
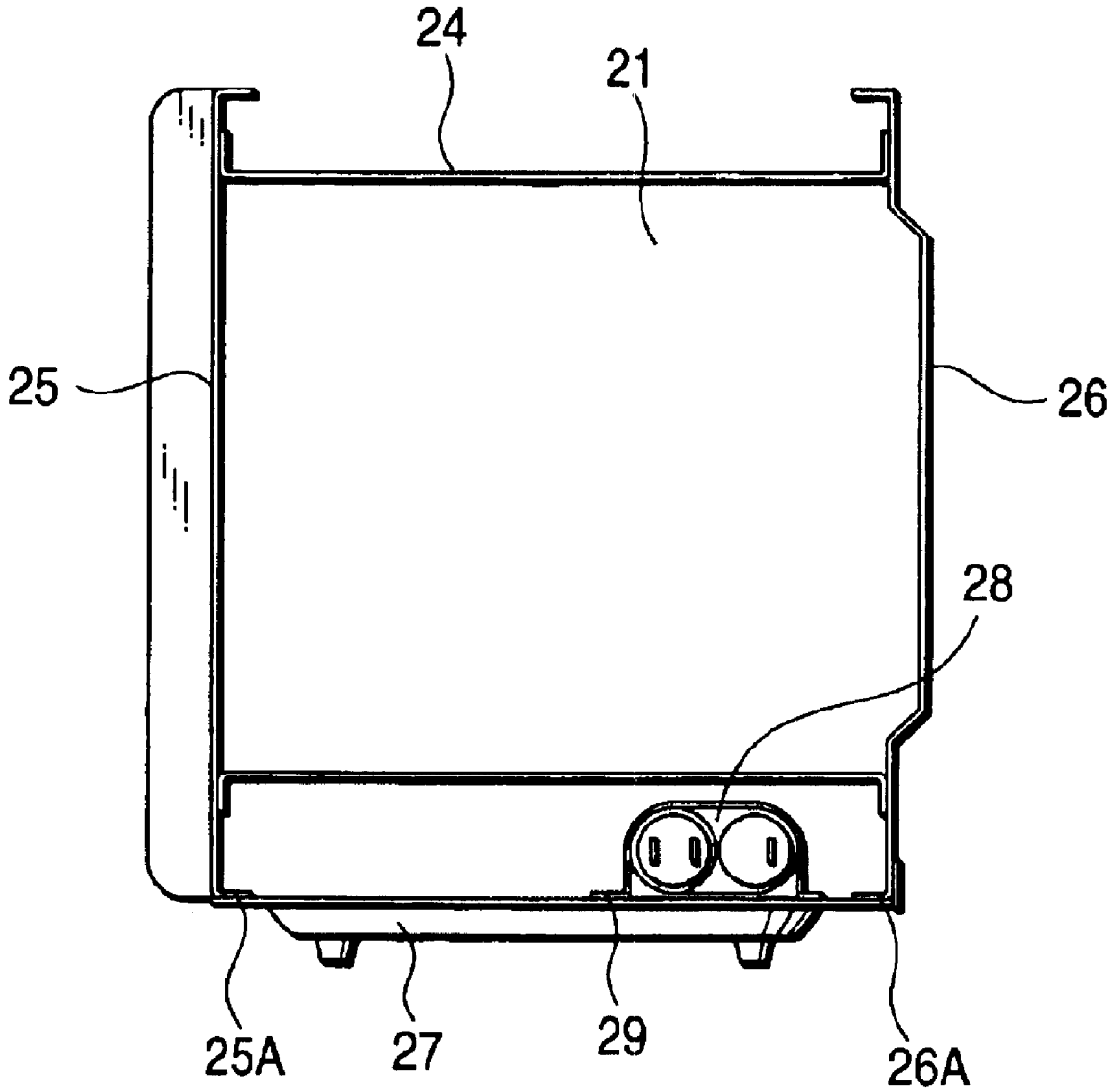
FIG. 3 is a transverse sectional view showing an attachment state of the high-voltage condenser in the first embodiment of the invention.

FIG. 1 is a perspective view showing a high-voltage condenser attaching method in a first embodiment of the invention. FIG. 2 is a sectional view showing an arrangement state of the high-voltage condenser in the first embodiment. FIG. 3 is a transverse sectional view showing an attachment position in the first embodiment.

A heating chamber 21 of a high-frequency heating apparatus includes side plates 22, a lower plate 23, a upper plate 24, a front plate 25 and a back plate 26. And, flange portions 25A and 26A are formed at lower ends of the front plate 25 and the back plate 26 to attach a bottom plate 27 thereto. A high-voltage condenser 28 is attached through an attachment fittings 29 to the bottom plate 27 so that a part of a body 28A of the high-voltage condenser 28 is arranged between the lower plate 23 constituting the heating chamber 21 and the bottom plate 27. In the first aspect, since a part of the body 28A (having the length L3) of the high-voltage condenser 28 is arranged between the heating chamber lower plate 23 and the bottom plate 27, the dimension necessary to attach the high-voltage condenser 28 can be reduced, so that size-reduction and space-reduction of the high-frequency heating apparatus can be performed. Further, since dimensional allowances can be provided, an insulation distance between the high-voltage condenser 28 and the metal-made back plate or an outer frame 30 can be easily secured, and it is not necessary to stick an insulating sheet to the outer frame or to cover a lead wire with an insulating tube. Therefore, problems in resources-reduction, assembly efficiency, and price can be solved.

Embodiment 2

Figure 4:
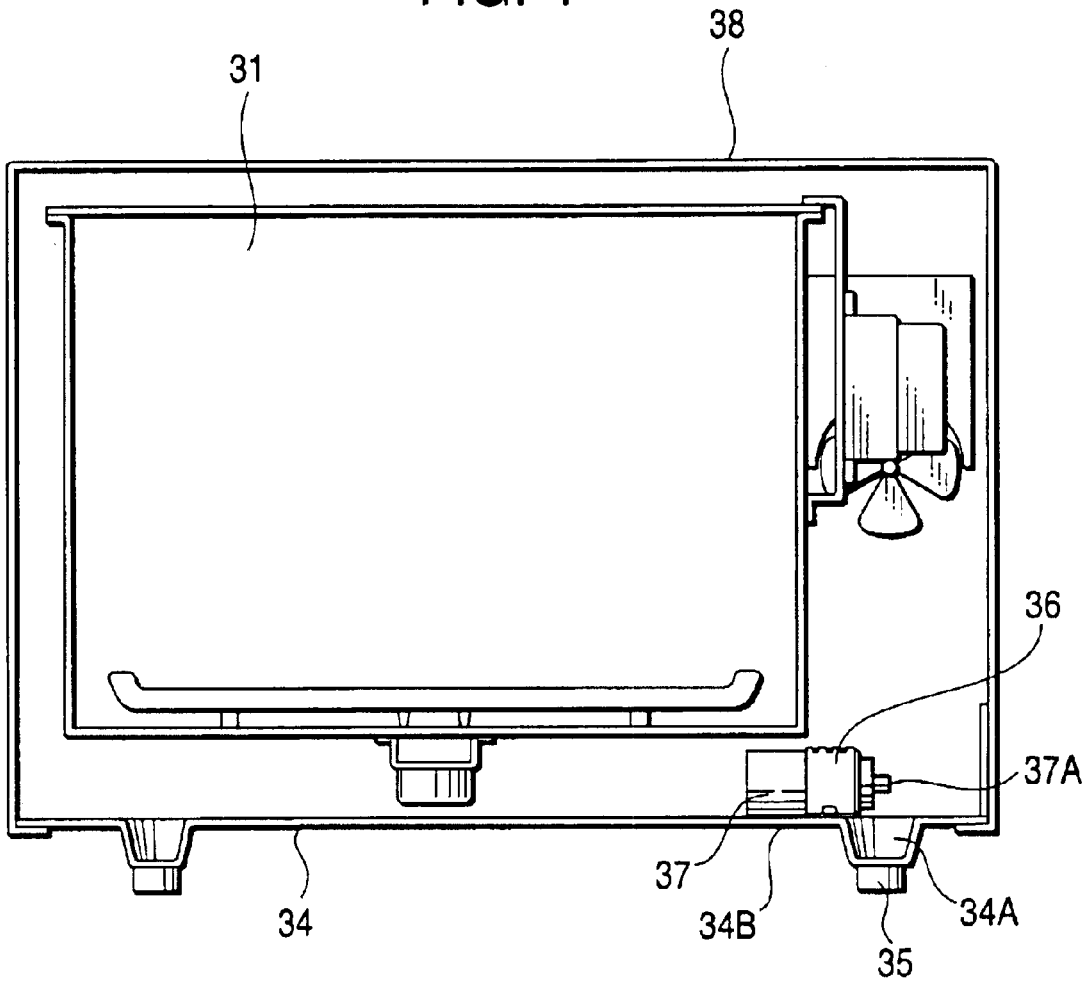
FIG. 4 is a sectional view showing an attaching position of a high-voltage condenser in a second embodiment of the invention.
Figure 5:
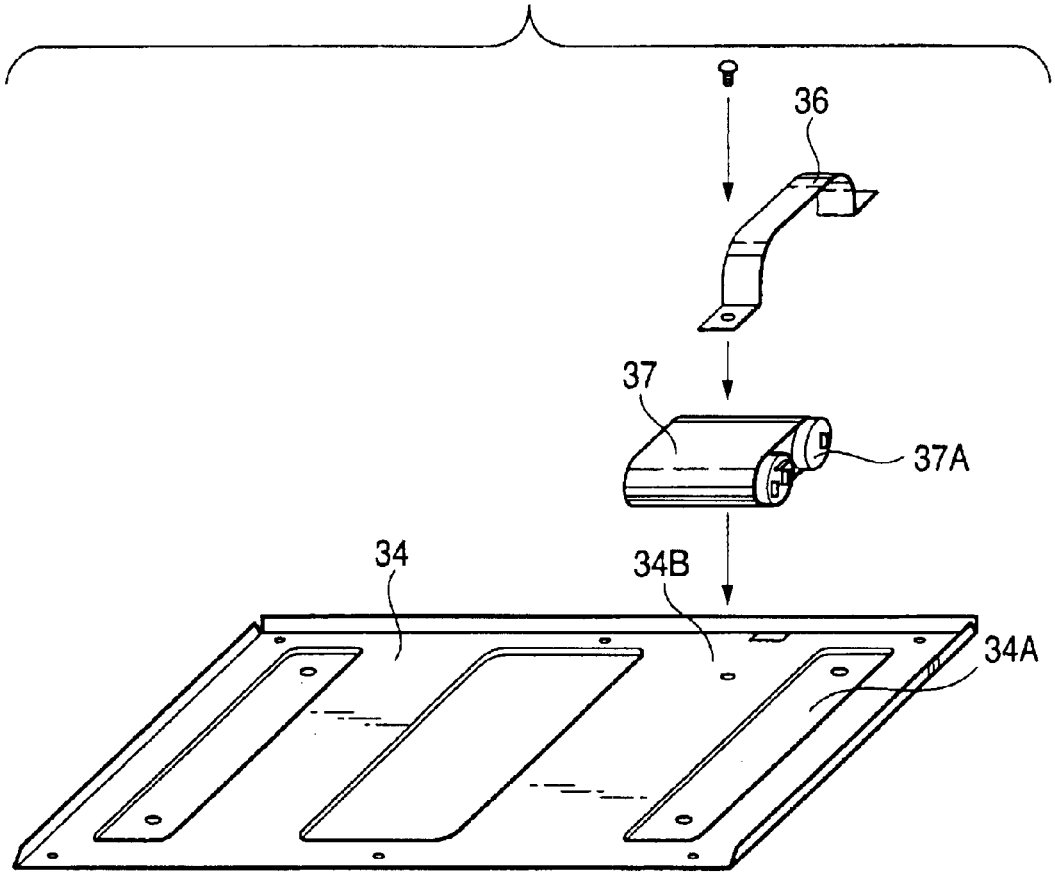
FIG. 5 is an exploded view showing an attaching procedure of the high-voltage condenser in the second embodiment of the invention.

FIG. 4 is a sectional view showing an attachment position of a high-voltage condenser in a second embodiment of the invention. FIG. 5 is an exploded view showing an attachment procedure of the high-voltage condenser in the second embodiment of the invention.

In FIGS. 4 and 5, a high-frequency heating apparatus has a heating chamber 31, and the heating chamber 31 includes a front plate, a back plate, and the like similar to the first embodiment. A bottom plate 34 is attached to lower ends of the front plate and the back plate, and has valley portions 34A serving as legs for attaching leg rubbers 35 and mountainous portion 34B.

The leg rubbers 35 are attached at positions a little distant from the back plate or an outer frame 38 in order to support the high-frequency heating apparatus with balance. To the mountainous portion 34B of the bottom plate 34, a high-voltage condenser 37 is attached through an attachment fittings 36 so that a terminal portion 37A of the high-voltage condenser 37 is arranged on the valley portion 34A of the bottom plate.

Since the terminal portion 37A of the high-voltage condenser 37 is arranged on the valley portion 34A formed in the bottom plate 34, an insulation distance between the terminal portion 37A of the high-voltage condenser and the metal-made back plate, the bottom plate 34 or the outer frame 38 can be sufficiently secured, and it is not necessary to stick an insulating sheet to the outer frame or to cover a lead wire with an insulating tube. Therefore, problems in resources-reduction, assembly efficiency, and price-can be solved.

Embodiment 3

Figure 6:
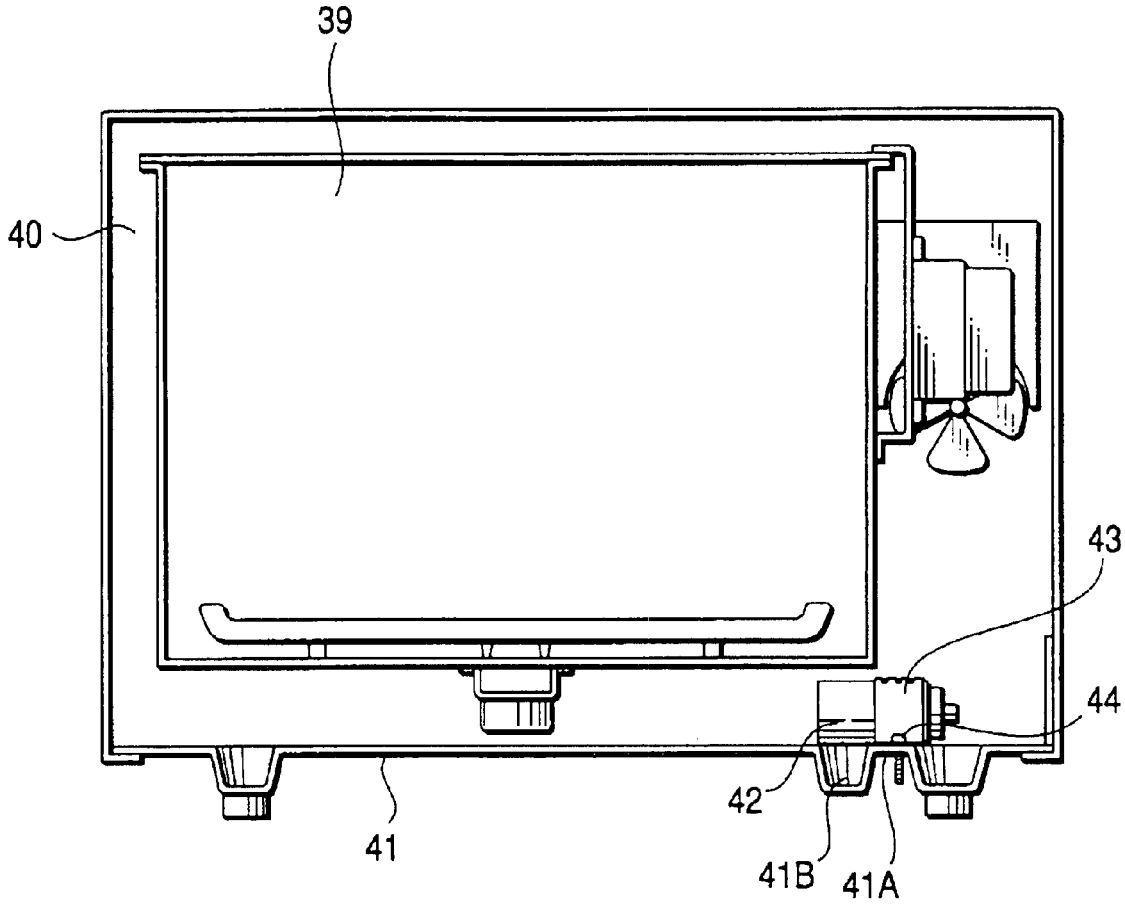
FIG. 6 is a sectional view showing an attaching state of a high-voltage condenser in a third embodiment of the invention.
Figure 7:
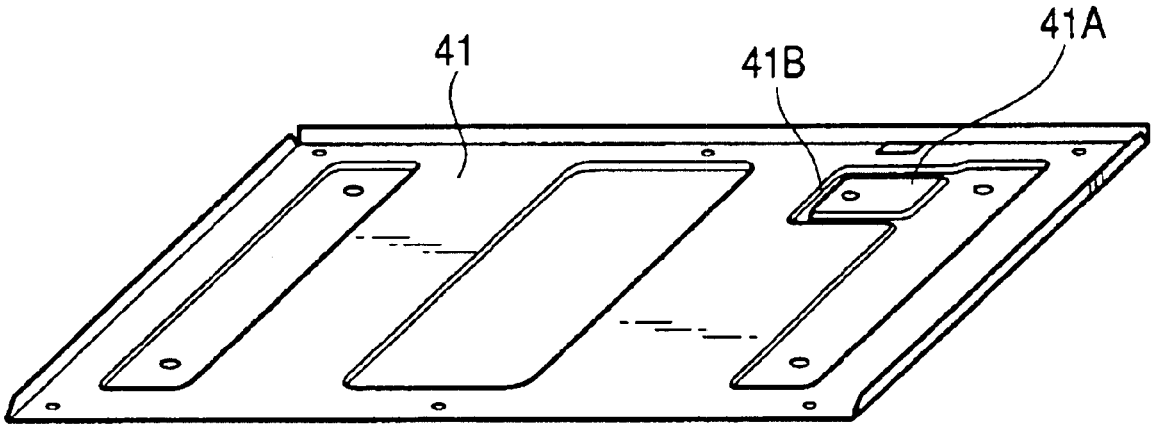
FIG. 7 is a perspective view showing a shape of a bottom plate in the third embodiment of the invention.

FIG. 6 is a sectional view showing an attachment state of a high-voltage condenser in a third embodiment of the invention. FIG. 7 is a perspective view showing a shape of a bottom plate in the third embodiment of the invention.

In FIGS. 6 and 7, a high-frequency heating apparatus has a heating chamber 39, and the heating chamber 39 includes a back plate 40 and the like. A bottom plate 41 is attached to lower ends of the back plate 40. To a mountainous portion 41A of the bottom plate 41, a high-voltage condenser 42 is attached through an attachment fittings 43 with a screw 44 from the inside of the high-frequency heating apparatus. Valley portions 41B are formed around the mountainous portion 41A of the bottom plate 41, which are deeper than the length of the screw 44 protruding downward from the bottom plate 41.

In order to hold the high-voltage condenser 42, the screw 44 thus protrudes downward from the inside of the high-frequency apparatus through the bottom plate 41. However, such the problems that the unpleasant feeling is given by touch of the screw on user's hand at the carrying time of the high-frequency heating apparatus and a sense of incompatibility in appearance is given because the screw can be seen from the downside of the bottom plate can be solved because the surroundings of the screw 44 is covered with the valley portions 41B formed in the bottom plate 41.

Embodiment 4

Figure 8:
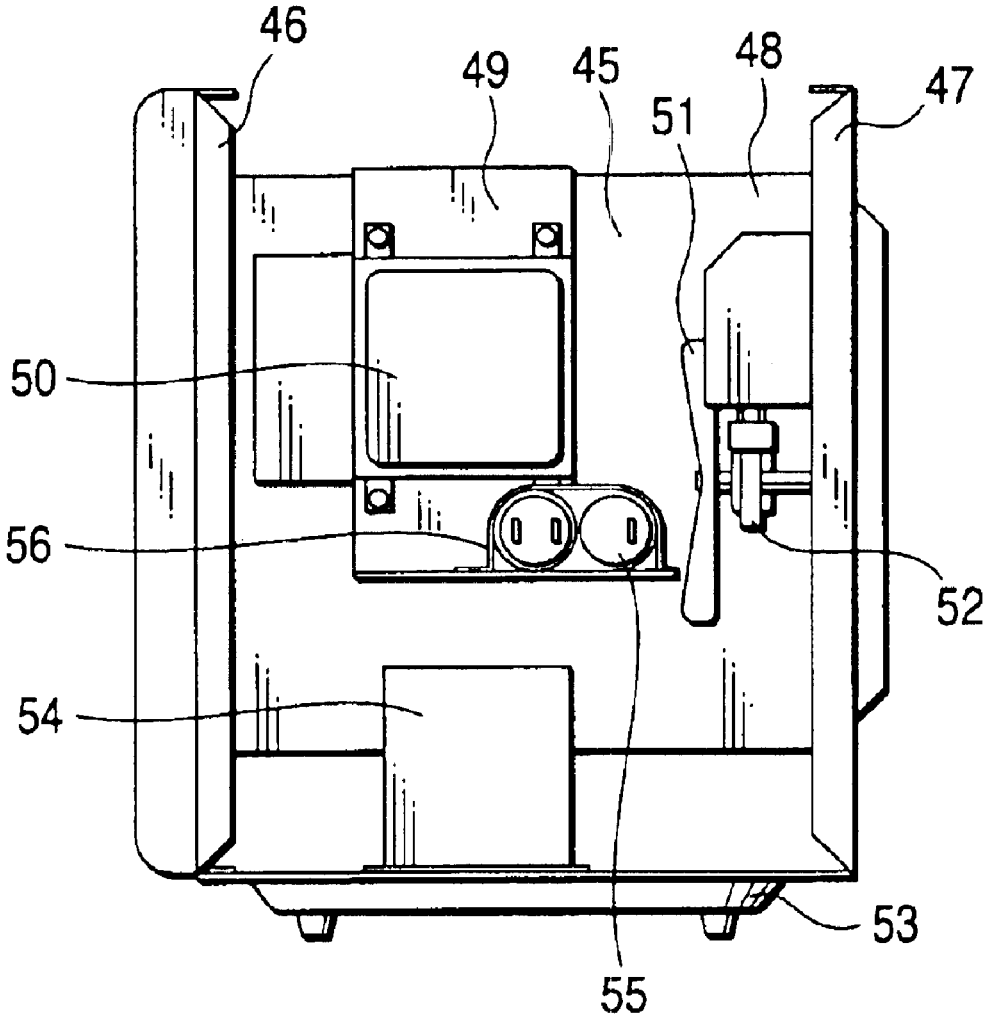
FIG. 8 is a side view showing an attaching state of a high-voltage condenser in a fourth embodiment of the invention.

FIG. 8 is a side view showing an attachment state of a high-voltage condenser in a fourth embodiment of the invention.

In the figure, a high-frequency heating apparatus has a heating chamber 45, and the heating chamber includes a front plate 46, a back plate 47, side plates 48, and the like. To the side plate 48, a magnetron attaching plate 49 is fixed, and a magnetron 50 is attached onto it's the magnetron attaching plate 49. To the back plate 47, a cooling motor 52 having a cooling fan 51 is attached. At lower ends of the front plate 46 and the back plate 47, a bottom plate 53 is attached, and a high-voltage transformer 54 is fixed onto the bottom plate 53. A high-voltage condenser 55 is attached through an attachment fittings 56 onto the magnetron attaching plate 49 at a position closer to the windward of the cooling fan 51 than the magnetron 50 and the high-pressure transformer 54.

In the fourth embodiment of the invention, since the high-voltage condenser 55 is held on the magnetron attaching plate 49, it can be held at a position sufficiently distant from the metal-made back plate 47 and bottom plate 53. Therefore, it is not necessary to cover a lead wire with a insulating tube because of shortage of the insulation distance, so that it is possible to solve the problems in resources-reduction, assembly efficiency, and price.

Figure 10:
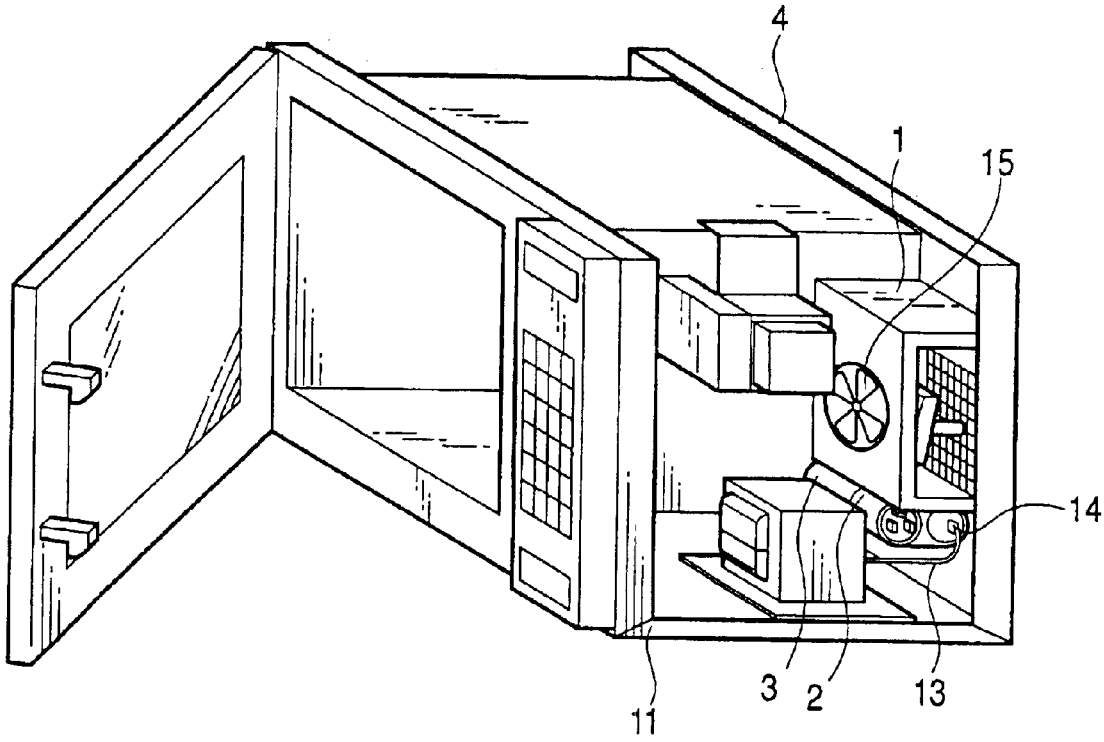
FIG. 10 is a perspective view showing an attaching state of a high-voltage condenser in a conventional example.
Figure 11:
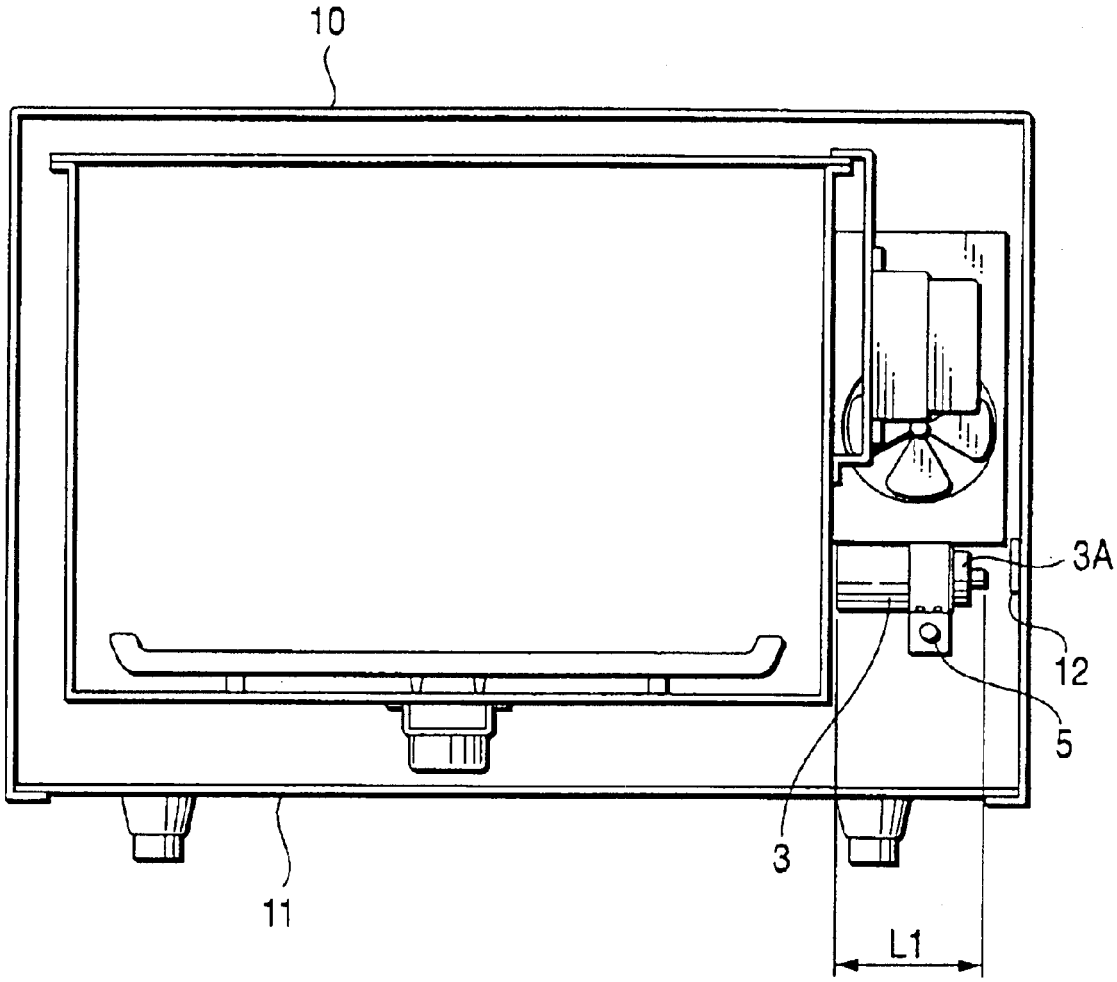
FIG. 11 is a sectional view showing the constitution in the conventional example.
Figure 12:
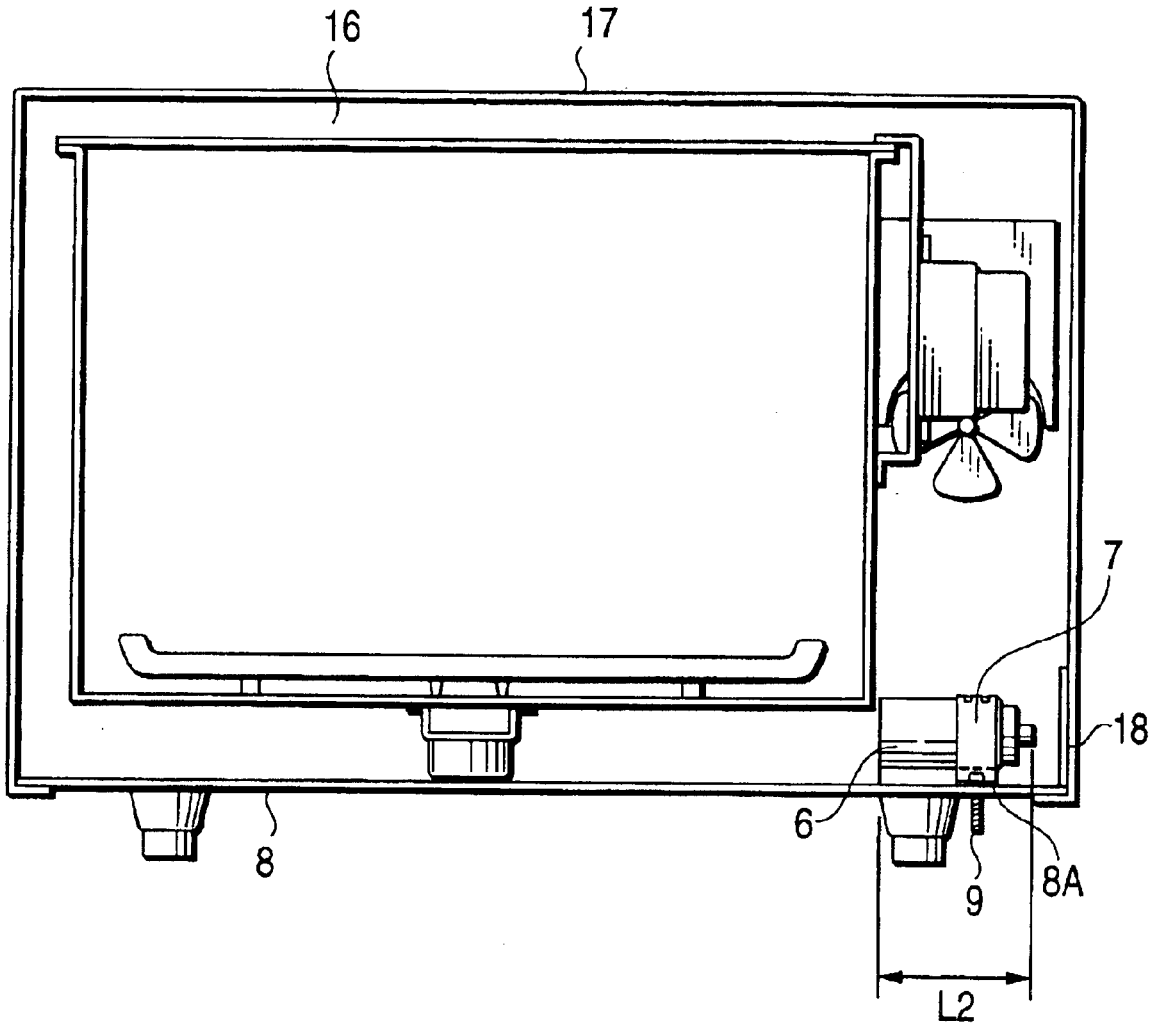
FIG. 12 is a sectional view showing an attaching state of a high-voltage condenser in a conventional example.
Figure 13:
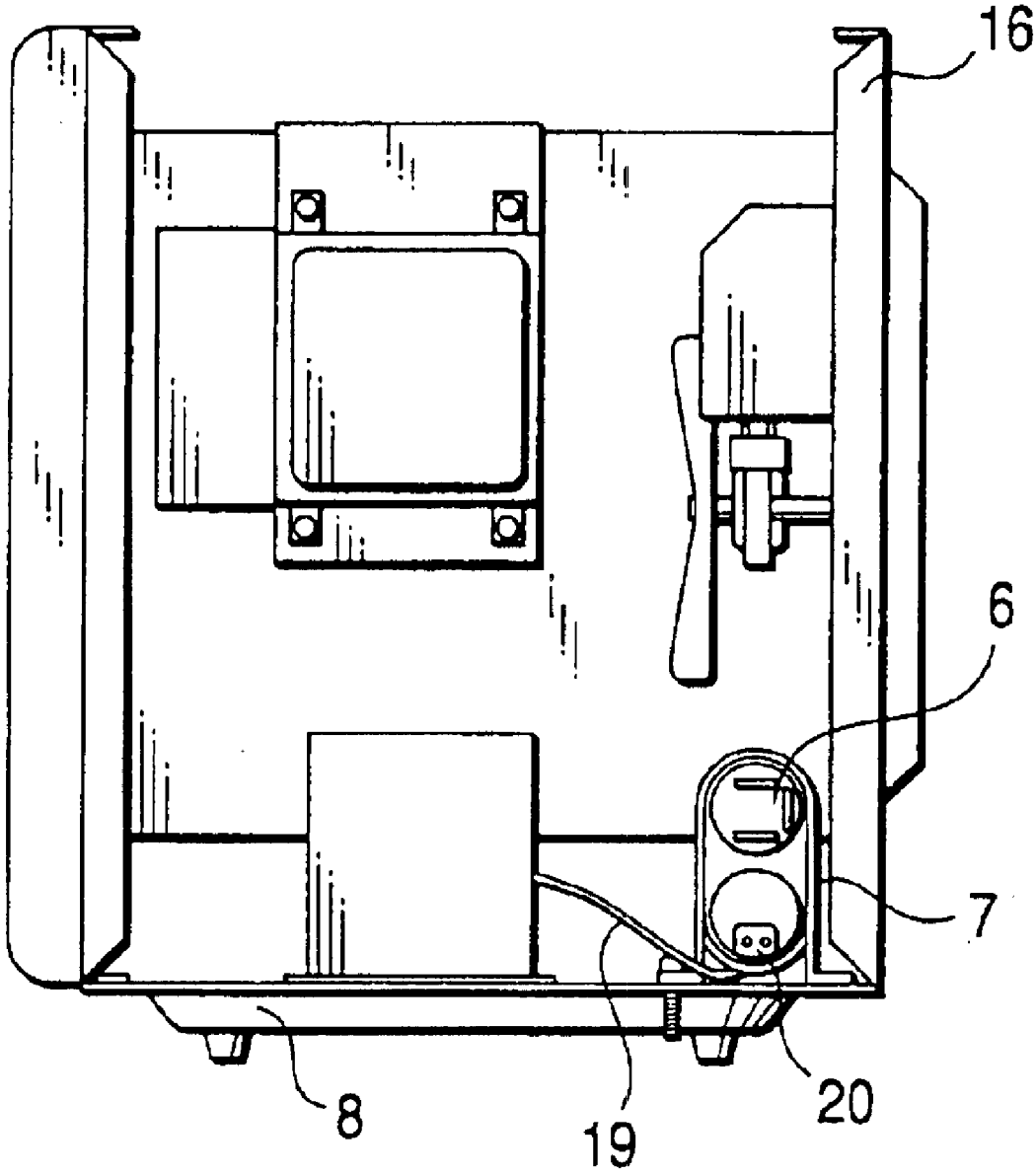
FIG. 13 is a transverse sectional view showing the constitution in the conventional example.

Further, since the high-voltage condenser 55 is arranged at the position nearer to cooling fan 51 than the magnetron 50 and the high-voltage transformer 54 and arranged on the windward side of the cooling fan 51 hereby to forcedly receive wind of lower temperature, increase of temperature of the high-voltage condenser 55 can be suppressed more than where natural cooling is performed, so that level-up of output of the high-frequency heating apparatus can be facilitated. In the fourth embodiment, the temperature of the high-frequency heating apparatus can be reduced by 8° C. compared with that in the example shown in FIG. 10.

Embodiment 5

Figure 9:
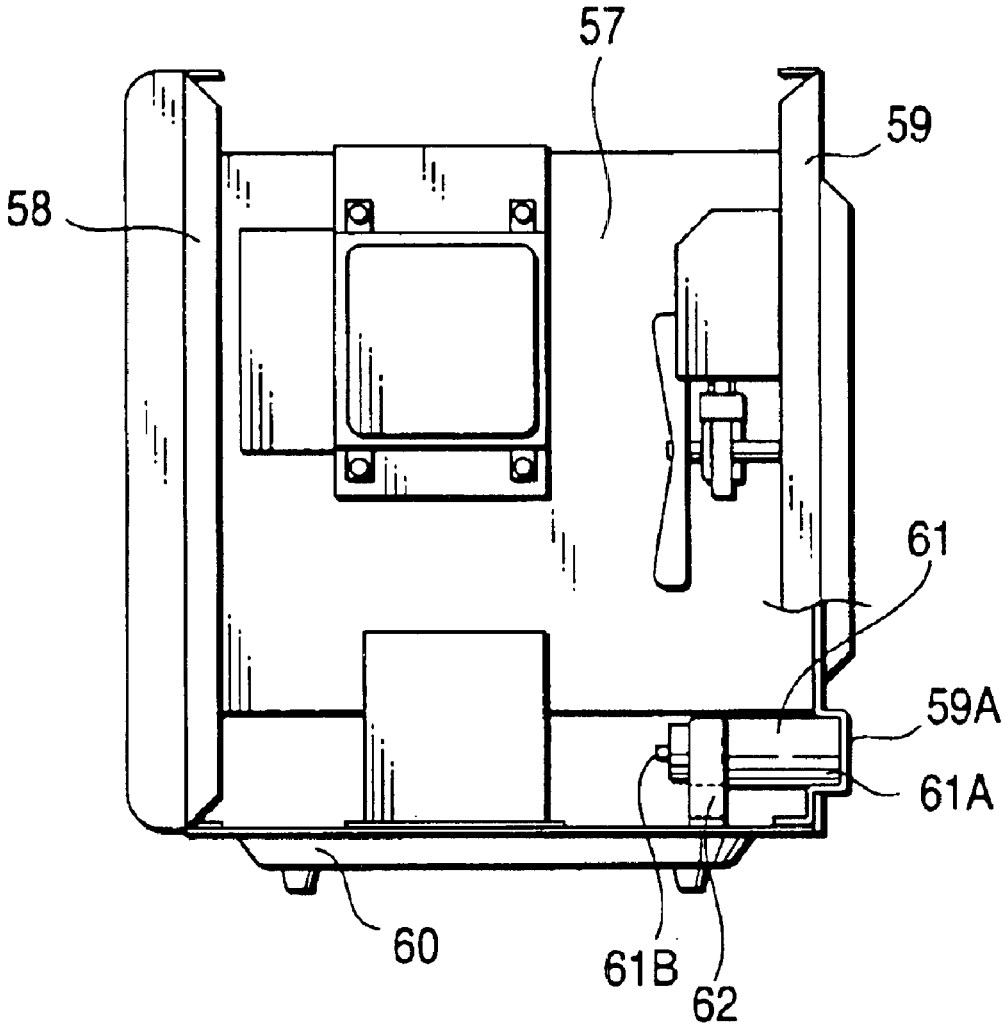
FIG. 9 is a side view showing an attaching state of a high-voltage condenser in a fifth embodiment of the invention.

FIG. 9 is a side view showing an attachment state of a high-voltage condenser in a fifth embodiment of the invention.

A bottom plate 60 is attached to lower ends of a front plate 58 and a back plate 59 that constitute a heating chamber 57. At the back plate 59, a drawn portion 59A protruding backward (projecting to outer side of the high-frequency heating apparatus) is formed, a back portion 61A of a high-voltage condenser 61 is inserted into the drawn portion 59A, a terminal portion 61B side of the high-voltage condenser 61 is held by an attachment fittings 62, the attachment fittings 62 is fixed to the bottom plate 60, and the high-voltage condenser 61 is arranged in the depth direction of the high-frequency heating apparatus.

Since the high-voltage condenser 61 is thus arranged in the depth direction of the high-frequency heating apparatus, the width dimension of the high-voltage condenser is sufficient for attachment. Therefore, it is possible to solve the problem that the size-reduction and space-reduction of the high-frequency heating apparatus are difficult, because the dimension is regulated by the length of the high-voltage condenser.

Further, since the high-voltage condenser 61 is held by the drawn portion 59A formed at the back plate 59 and the attachment fittings 62 located in the vicinity of the terminal portion 61B, it is easy to secure the insulation distance between the high-voltage condenser 61 and the metal-made back plate 59 or the bottom plate 60, and it is not necessary to cover a lead wire with an insulating tube. Therefore, it is possible to solve such the problems in resources-reduction, assembly efficiency, and price.

Although the description is made with reference to the specific embodiments, however, the present invention is not limited to the embodiments but various variations and modifications can be applied. In addition, each embodiment can be applied to other embodiments.

As described above, according to the first aspect of the invention, since a part of the body of the high-voltage condenser 28 is arranged between the heating chamber lower plate 23 and the bottom plate 27, the dimension necessary to attach the high-voltage condenser 28 can be reduced, so that problems in size-reduction and space-reduction of the high-frequency heating apparatus can be performed.

Further, since dimensional allowances for attachment of the high-voltage condenser 28 can be provided, the distance between the high-voltage condenser 28 and the metal-made back plate 26 or the outer frame 30 can be easily secured. Therefore, it is not necessary to cover the lead wire with the insulating tube, so that the problems in resources-reduction, assembly efficiency, and price can be solved.

According to the second aspect of the invention, the terminal portion 37A of the high-voltage condenser 37 is arranged on the valley portion 34A formed in the bottom plate 34 in order to attach the leg rubber 35, and the high-voltage condenser 37 is held through the attachment fittings 36 at the mountainous portion 34B of the bottom plate. Hereby, the insulation distance between the terminal portion 37A of the high-voltage condenser and the metal-made back plate, the outer frame 38, or the bottom plate 34 can be secured readily. Therefore, it is not necessary to stick the insulating sheet on the inside of the outer frame or to cover the lead wire with the insulating tube, so that the problems in resources-reduction, assembly efficiency, and price can be solved.

According to the third aspect of the invention, the attachment fittings 43 for holding the high-voltage condenser 42 is fixed to the mountainous portion 41A formed at the bottom plate 41 with the screw 44, and the screw 44 is surrounded by the valley portions 41B formed in the bottom plate 41. Hereby, it is possible to solve such the problems that an unpleasant feeling is given by touch of the screw on user's hand when the high-frequency heating apparatus is carried, and that a sense of incompatibility in appearance is given by the protrusion of the screw from the bottom plate.

According to the fourth aspect of the invention, the high-voltage condenser 55 is arranged through the attachment fittings 56 on the magnetron attaching plate 49 at the position nearer to the windward of the cooling fan 51 than the magnetron 50 and the high-voltage transformer 54. Hereby, the insulation distance from the back plate 47 or the bottom plate 53 can be secured sufficiently, and the insulating sheet is not required, so that the problems in resources-reduction, assembly efficiency, and price can be solved. Further, since the high-voltage condenser can be cooled forcedly by the cooling fan 51, it is possible to suppress increase of the temperature of the high-voltage condenser and level-up of output of the high-frequency heating apparatus can be facilitated.

According to the fifth aspect of the invention, the high-voltage condenser 61 is held by the drawn portion 59A formed at the back plate 59 and the attachment fittings 62, and arranged in the depth direction of the high-frequency heating apparatus. Hereby, the width dimension (W1) of the high-voltage condenser 61 is sufficient for attachment. Therefore, it is possible to solve the problems in size-reduction and space-reduction of the high-frequency heating apparatus. Further, it is easy to secure the insulation distance between the high-voltage condenser 61 and the back plate 59 or the bottom plate 60, and the insulating sheet or the insulating tube is not required. Therefore, it is possible to solve the problems in resources-reduction, assembly efficiency, and price.

What is claimed is:

1. A high-frequency heating apparatus comprising:

a bottom plate having a valley portion and mountainous portion, wherein the valley portion is a leg;

a heating chamber having a lower plate, the lower plate provided to have a spacing from the bottom plate;

a high-voltage condenser having a terminal portion, wherein a part of the high-voltage condenser arranged between the lower plate and the bottom plate;

wherein said high-frequency heating apparatus further comprises an attachment fitting which holds the high-voltage condenser on the mountainous portion; and, wherein the terminal portion is arranged above the valley portion.

2. A high-frequency heating apparatus comprising:

a bottom plate having a valley portion and mountainous portion;

a heating chamber having a lower plate, the lower plate provided to have a spacing from the bottom plate;

a high-voltage condenser having a terminal portion, wherein a part of the high-voltage condenser is arranged between the lower plate and the bottom plate;

wherein said high-frequency heating apparatus further comprises and attachment fitting which holds the high-voltage condenser on the mountainous portion;

wherein the terminal portion is arranged above the valley portion; and, a leg rubber attached to the valley portion of the bottom plate at a face opposite to a face where the high-voltage condenser is attached.

3. A high-frequency heating apparatus comprising:

a bottom plate having a valley portion and a mountainous portion;

a heating chamber having a lower plate, the lower plate provided to have a spacing from the bottom plate;

a high-voltage condenser attached to the bottom plate, wherein a part of the high-voltage condenser is arranged between the lower plate and the bottom plate;

wherein the high-frequency heating apparatus further comprises an attachment fitting which holds the high-voltage condenser on the bottom plate, and which is fixed to the bottom plate with a screw at the mountainous portion from a side where the high-voltage condenser is attached; and, wherein the valley portion is formed to be deeper than the length of the screw, and to surround the screw.

* * * * *